US006109433A

United States Patent [19]

Pratt

[11] Patent Number: 6,109,433

[45] Date of Patent: Aug. 29, 2000

[54] RIDGED GOLF BAG DIVIDERS

[75] Inventor: Michael J. Pratt, Park City, Utah

[73] Assignee: OGIO International, Inc., Salt Lake City, Utah

[21] Appl. No.: 09/248,496

[22] Filed: Feb. 10, 1999

[51] Int. Cl.[7] ..... A63B 55/00; A63B 55/06

[52] U.S. Cl. ..... 206/315.6; 206/315.3; 206/315.7

[58] Field of Search ..... 206/315.6, 315.7, 206/315.3

[56] References Cited

U.S. PATENT DOCUMENTS

| | | | |
|---|---|---|---|
| D. 364,737 | 12/1995 | Perrin | D3/255 |
| D. 382,707 | 8/1997 | Wang | D3/255 |
| 1,780,802 | 11/1930 | Sutcliffe | 206/315.6 |
| 2,064,542 | 12/1936 | Jones | 206/315.6 |
| 2,551,780 | 5/1951 | Wood | 206/315.6 X |
| 3,139,132 | 6/1964 | Shiller | 206/315.6 |
| 4,194,547 | 3/1980 | Sidor et al. | 206/315.6 |
| 4,208,227 | 6/1980 | Cowan | 206/315.6 |
| 4,596,328 | 6/1986 | Solheim | 206/315.6 |
| 4,673,082 | 6/1987 | Hemme | 206/315.6 |
| 4,709,814 | 12/1987 | Antonious | 206/315.3 |
| 4,834,235 | 5/1989 | Solheim et al. | 206/315.8 X |
| 5,029,703 | 7/1991 | Dulyea, Sr. | 206/315.3 |
| 5,238,109 | 8/1993 | Smith | 206/315.2 |
| 5,279,414 | 1/1994 | Brasher | 206/315.6 |
| 5,465,840 | 11/1995 | Joh | 206/315.6 |
| 5,634,557 | 6/1997 | Shin et al. | 206/315.6 |
| 5,645,166 | 7/1997 | Su | 206/315.6 |
| 5,732,819 | 3/1998 | Nishimura et al. | 206/315.3 |
| 5,772,024 | 6/1998 | Lueders | 206/315.6 |
| 5,775,513 | 7/1998 | Anthony | 206/315.3 |

*Primary Examiner*—Sue A. Weaver
*Attorney, Agent, or Firm*—Workman, Nydegger & Seeley

[57] ABSTRACT

The present invention is directed to a golf bag for holding golf clubs, the golf bag having a club storage portion with a base, an open upper end, and a sidewall; a stand affixed to the sidewall for positioning the golf bag in a partially reclined position; and at least one ridged element in the open upper end having ridges and valleys oriented and positioned such that when the golf bag is in the partially-reclined position, the golf clubs rest unrestrained and separated within the valleys between the ridges. The present invention facilitates retrieval of golf clubs when the golf bag is in the partially reclined position by spreading the clubs out in the valleys, without requiring cumbersome or complex retaining or isolating mechanisms.

13 Claims, 3 Drawing Sheets

RIDGED GOLF BAG DIVIDERS

FIELD OF THE INVENTION

The present invention relates to a golf bag for holding a plurality of unrestrained golf clubs, and more specifically, to a golf bag that facilitates easy retrieval of the golf clubs held therein.

BACKGROUND

In basic form, a conventional golf bag is simply an elongated container with an open top for receiving and carrying a plurality of golf clubs. Typical golf bags include a variety of features designed to make golf club transport and retrieval more convenient. Such features include those designed to make transporting and using the golf bag easier, such as carrying straps and integrated stands, as well as those designed to improve club storage and organization.

Past efforts at improving club storage and organization have focused on a number of perceived deficiencies of conventional golf bag designs. A typical golf bag, as used by most golfers, contains approximately fourteen golf clubs. When these clubs rest within a single-compartment golf bag, the clubs are free to move within the compartment, and maintain no particular organization. In addition, it is inconvenient to select and retrieve a desired club when the clubs rest together without separation.

The prior art includes a number of solutions to these perceived problems of club disorganization. One simple solution has been to divide the single club storage compartment into several compartments by placing dividing elements in the open top. This minimal solution, however, has proven to be inadequate, as the degree of organization afforded by placing the clubs in several compartments is still insufficient for many golfers. Thus, a number of prior art patents are directed to golf bags having an individual storage compartment for each golf club. For example, U.S. Pat. No. 5,772,024 discloses a golf bag having a top plate with bores shaped to allow club shafts to pass through, a bottom plate with pegs shaped and spaced to receive club shaft ends, and flexible tubes running between the bores and the pegs to contain and isolate each golf club separately. Similarly, U.S. Pat. No. 5,775,513 teaches a golf club holder with a floor having holes sized for a golf club shaft, a top portion having wedge-shaped compartments to receive club heads, and tubes running between the wedge-shaped compartments and the floor holes to isolate and contain each golf club. Other similar efforts include U.S. Pat. No. 5,634,557 (foam organizer having vertical bores for individual club shafts), U.S. Pat. No. 5,465,840 (plurality of separate storage compartments having a lower portion for receiving and isolating club shafts and an upper portion for receiving and isolating club heads), and U.S. Pat. No. 5,279,414 (golf bag to hold clubs head-down, having partitions to isolate each individual club), to name but a few.

Several other patents achieve club isolation and organization by using clipping or other retaining mechanisms to physically restrain each individual golf club. For example, U.S. Pat. No. 5,029,703 discloses a golf bag organizer including a base having sockets to receive individual club shaft ends, and a rack having retainer elements to grip and secure each golf club. U.S. Pat. No. 3,139,132 teaches a golf bag having a plurality of partitions separating individual golf clubs, and means for holding the shafts, such as spring-pressed rubber rollers. U.S. Pat. No. 5,645,166 teaches a locating block mounted in the top of a golf bag and having a plurality of clip-like "locating ribs" for holding individual golf clubs in place. Similarly, U.S. Pat. No. 5,238,109 discloses a golf club holder having a plurality of parallel channels. A club is inserted into a channel by forcing the channel to flex slightly open, and is then held securely in the channel when the flexing force is removed.

While these past efforts have offered various solutions aimed at improving club organization and storage, for many golfers, these solutions represent impediments, rather than improvements. For example, many golfers find features that require individual clubs to be placed in individual compartments particularly inconvenient to use, since the club must be directed carefully into a confined space each time it is stowed. Similarly, features that require clubs to be clipped or otherwise restrained simply add another step to club stowage and retrieval, and such features prove to be inconvenient and even frustrating to many golfers. Thus, despite the need for golf bags having improved club organization and storage, the majority of golfers still prefer to use conventional golf bags having typically two to six compartments separated by simple dividers.

SUMMARY OF THE INVENTION

To overcome the disadvantages and deficiencies discussed above, what is needed is a golf bag that combines the convenience of a conventional golf bag in which clubs are easily stowed and retrieved unrestrained and without regard to position, and the added organization afforded by golf bags which present clubs separated for easy selection and retrieval.

It is therefore an object of the present invention to provide a golf bag in which golf clubs are stored unrestrained, for simple and convenient stowage.

It is a further object of the invention to provide a golf bag in which the golf clubs are organized for easy selection and retrieval at the time of club usage.

In accordance with these and other objects and features, the present invention provides a golf bag for holding golf clubs, the golf bag having a club storage portion with a base, an open upper end, and a sidewall; a stand affixed to the sidewall for positioning the golf bag in a partially reclined position; and at least one ridged element in the open upper end having ridges and valleys oriented and positioned such that when the golf bag is in the partially-reclined position, the golf clubs tend to rest unrestrained and separated within the valleys and between the ridges. The present invention facilitates retrieval of golf clubs when the golf bag is in the partially reclined position by spreading the clubs out in the valleys, without requiring cumbersome or complex retaining or isolating mechanisms.

These and other objects and features of the present invention will become more fully apparent from the following description and appended claims, or may be learned by the practice of the invention as set forth hereinafter.

BRIEF DESCRIPTION OF THE DRAWINGS

In order to illustrate the manner in which the above-recited and other advantages and objects of the invention are obtained, a more particular description of the invention briefly described above will be rendered by reference to the specific embodiments shown in the appended drawings. Understanding that these drawings depict only typical embodiments of the invention and are not therefore limiting of its scope, the invention will be described and explained with additional specificity and detail through the use of the accompanying drawings, in which.

DETAILED DESCRIPTION OF THE PREFERRED EMBODIMENTS

While playing golf, a golfer must transport a set of golf clubs, typically about fourteen, and must repeatedly select, retrieve and stow the various clubs. Systems of club storage and organization, such as those in which clubs are held in individual compartments and/or are individually held by a restraining mechanism, offer organizational advantages, but are inconvenient and often frustrating to use for many golfers. Thus, the present invention combines the convenience of a conventional golf bag in which clubs are easily stowed and retrieved unrestrained and without regard to position, and the added organization afforded by presenting the clubs separated for easy selection and retrieval. The present invention does so by providing a golf bag having a club storage portion with a base, an open upper end, and an enclosed sidewall; a stand affixed to the sidewall for positioning the golf bag in a partially reclined position; and at least one ridged element in the open upper end having ridges and valleys oriented and positioned such that when the golf bag is in the partially-reclined position, the golf clubs tend to rest unrestrained and separated within the valleys between the ridges.

Figure 1:
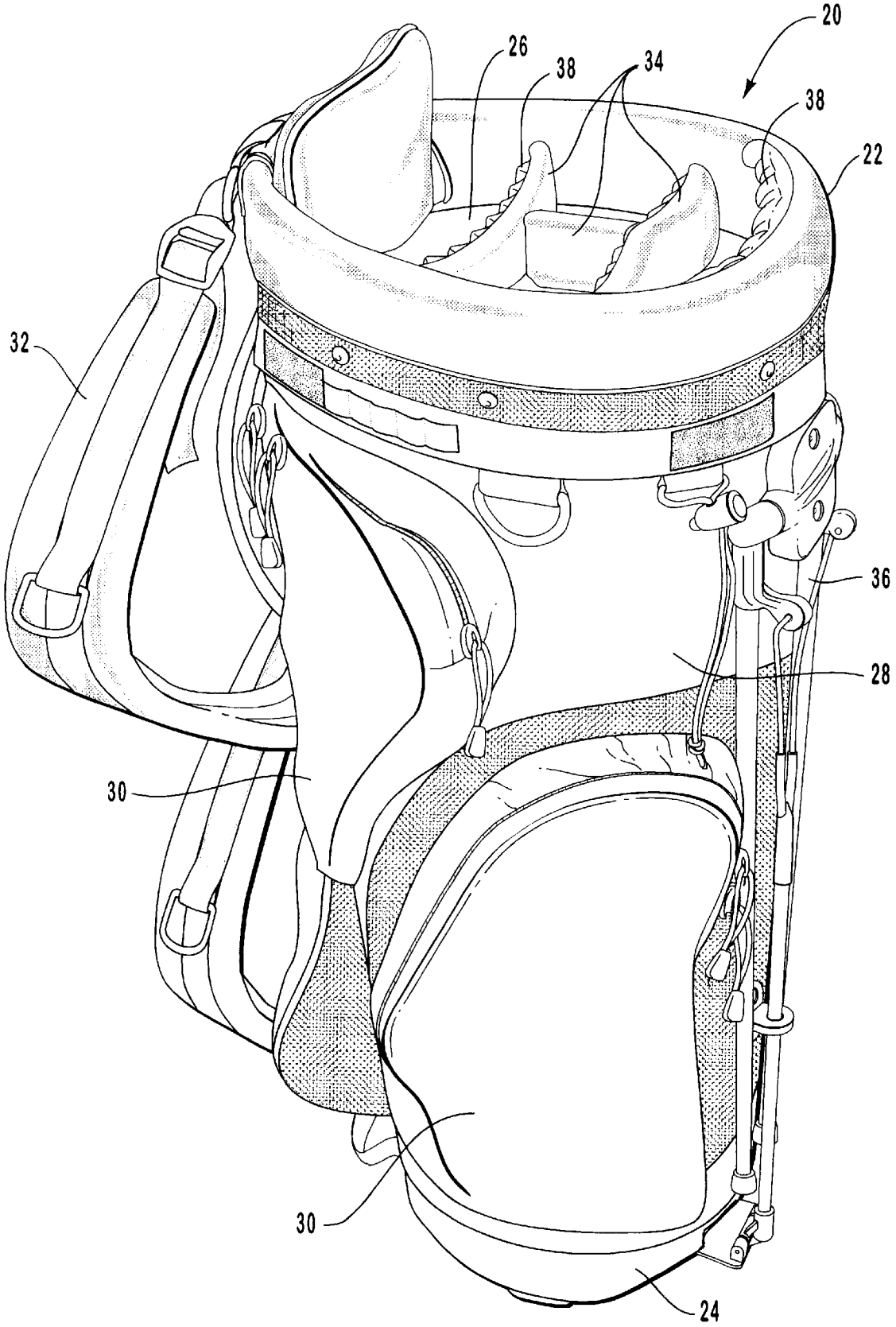
FIG. 1 shows a golf bag according to the present invention, in a substantially upright position.
Figure 2:
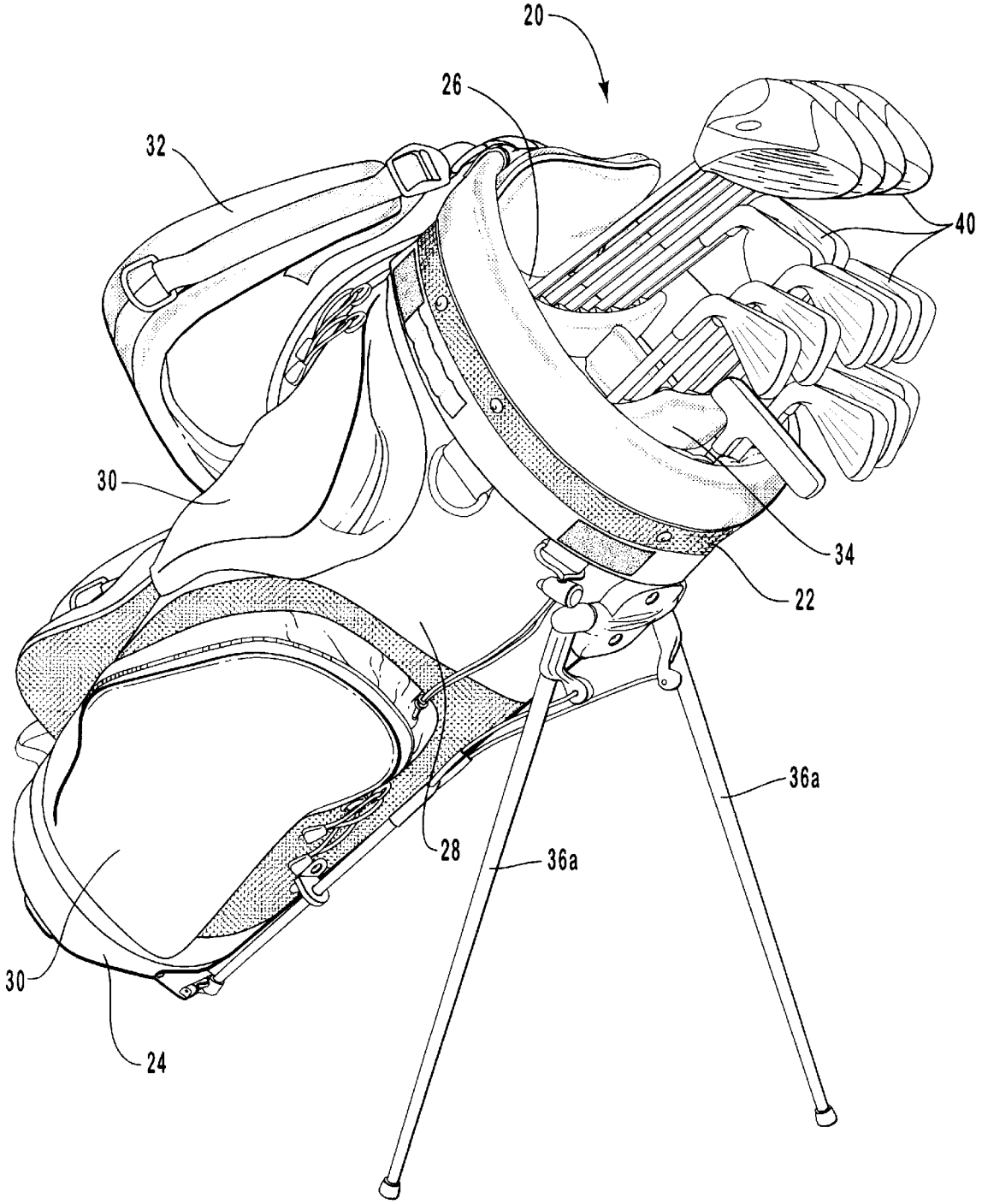
FIG. 2 shows a golf bag according to the present invention in a partially reclined position and containing golf clubs resting unrestrained but separated by ridged elements.

FIGS. 1 and 2 show an illustrative embodiment of a golf bag 20 according to the invention. FIG. 1 shows the golf bag 20 in a vertical position, while FIG. 2 shows the same golf bag 20 in a partially reclined position, and holding a plurality of golf clubs denoted generally as 40.

The golf bag 20 has a club storage portion 22 for holding a plurality of golf clubs 40 (shown in FIG. 2). The club storage portion 22 includes a base 24, an open upper end 26, and an enclosed sidewall 28 extending between the base 24 and the open upper end 26. The club storage portion 22 can be any such portion suitable for holding golf clubs unrestrained, and in particular can be a conventional club storage portion such as is well-known in the art. For example, the base 24 can be a conventional base, and can be made of any base material conventionally used in golf bags, such as leather, plastic, fiberglass, aluminum and the like. Similarly, the sidewall 28 can be a conventional golf bag sidewall, made from conventional materials such as leather, plastic, fabric, etc. Preferably, the sidewall 28 has a horizontal cross-section that is approximately circular or oval, as is commonly used in golf bags. As shown in FIGS. 1 and 2, the sidewall 28 may have conventional attachments, such as pockets 30, carrying straps 32, and other convenient accessories well-known in the art. The open upper end 26 can have a single continuous opening, or can be divided into several compartments by one or more dividers 34, as desired. Preferably, the open upper end is divided into at least two compartments, to facilitate club separation and organization. Dividers 34 are preferably somewhat rigid, to provide support against compression of the open upper end 26. The dividers 34 are preferably padded with a soft and durable material that presents a non-damaging and cushioned surface to the golf club shafts, such as fabric or cushioning foam.

The golf bag 20 further includes a stand 36, having a closed position (FIG. 1) and an open position (FIG. 2). As shown in FIG. 1, the stand 36 in the closed position is disposed longitudinally along, and is substantially flush with, the sidewall 28. As shown in FIG. 2, the stand 36 in the open position includes two legs 36*a* extending away from the sidewall 28 such that the golf bag 20 is held in a partially reclined position. Although two legs are shown in the stand depicted in FIG. 2, it should be understood that any stand configuration capable of maintaining the golf bag in a partially-reclined position may be used. Such stands are conventional in the art, and can be made of any suitable material, such as a lightweight metal or metal alloy, plastic, fiberglass or the like.

Figure 3:
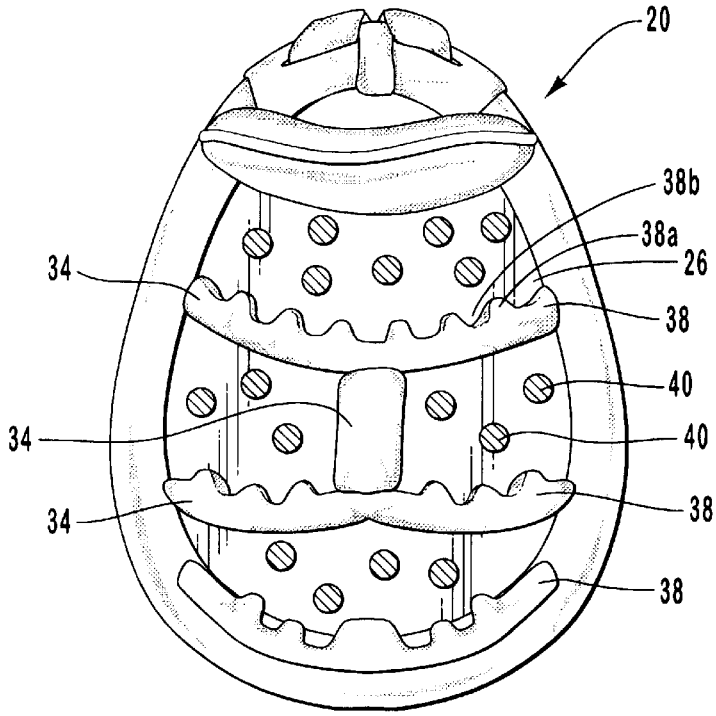
FIG. 3 shows a top plan view of a golf bag according to one embodiment of the present invention, in a substantially upright position and containing unrestrained golf clubs, wherein the shafts of the golf clubs are shown in cross-section.

FIG. 3 shows a top plan view of a golf bag 20 in the vertical position; i.e., with the stand 36 in the closed position. For clarity, stand 36 is not shown in FIG. 3. The shafts of the golf clubs 40 are shown in cross-section. The golf bag 20 further includes at least one ridged element 38 disposed within the open upper end 26. The ridged element 38 includes a plurality of ridges 38*a* and a plurality of valleys 38*b*. The ridged element may be disposed along a portion of an inner surface of the open upper end 26, along a surface of one or more of the optional dividers 34, or preferably both. As shown in the particular embodiment of FIG. 3, ridged elements 38 are disposed along three such surfaces.

In the view of FIG. 3, the golf bag 20 is in the vertical position, and the golf clubs 40 are positioned randomly within the club storage portion. Although the golf clubs 40 are not shown to be resting against any surface, it should be appreciated that in the vertical position the golf clubs 40 are unrestrained, and may rest randomly against any surface of the open upper end or dividers.

Figure 4:
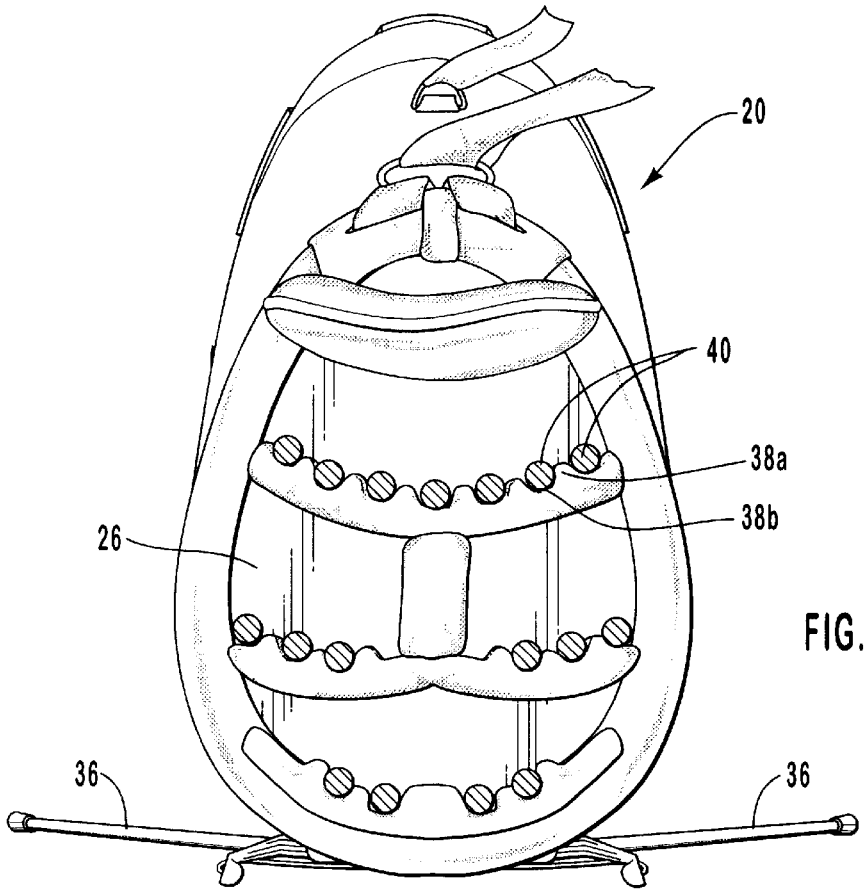
FIG. 4 shows a top plan view of a golf bag according to one embodiment of the present invention, in a partially reclined position and containing golf clubs resting unrestrained but separated by ridged elements, wherein the shafts of the golf clubs are shown in cross-section.

FIG. 4 shows a top plan view of the golf bag 20 held in the partially-reclined position by the stand 36 in the open position. The shafts of the golf clubs 40 are shown in cross-section. The ridged elements 38 are oriented within the open upper end 26 facing away from the stand, so that when the golf bag 20 is held in the partially-reclined position, the golf clubs 40 come to rest within the valleys 38*b* between the ridges 38*a* of the ridged elements 38. It is a particular feature of the present invention that the golf clubs 40 remain unrestrained when the golf bag is in the partially reclined position. The size and shape of the ridges 38*a* and valleys 38*b* of the ridged element 38 are chosen so that a golf club shaft is easily accommodated within a valley 38*b* without the need for the golfer to position the golf club or secure it. In particular, the ridges 38*a* and valleys 38*b* can be approximately "U-shaped", as shown in the Figures, or can have square, angular (i.e., "V-shaped") or other shapes as desired. When the bag is placed in the partially reclined position, the golf clubs naturally tend to fall toward the stand (i.e., downhill) and most come to rest within the valleys 38*b*. In this manner, the clubs are still in random order and unrestrained, but assume a more spread out configuration, thereby facilitating easy selection and retrieval of a particular club.

Although in FIG. 4 there is a one-to-one correspondence between ridged element valleys 38*b* and golf clubs 40, it should be appreciated that there can be provided more, or fewer, ridged element valleys. In the event that the number of golf clubs, either in the entire open upper end 26 or in a particular compartment contained therein, exceeds the number of nearby ridged element valleys 38*b*, not all of the golf clubs 40 will rest within a valley 38*b*. Nevertheless, this imperfect configuration still provides an increased level of organization, with the golf clubs at least partially spread out and resting within ridged element valleys 38*b*, and the ease of golf club selection and retrieval thereby enhanced.

In use, the golf bag of the present invention is particularly convenient. When golf clubs are clustered together in a conventional golf bag, club selection and retrieval are difficult. The golf clubs have different lengths, and the club heads tend to cluster and overlap, making it difficult to find and retrieve a particular golf club. In the present invention, because the golf clubs tend to rest in the valleys of the ridged elements, the golf clubs tend to be spread out and show less clustering and overlap, making it easy to see the available clubs and to select the desired club. Even when not all of the golf clubs come to rest within the valleys, i.e., when not all of the clubs are spread out, the present invention still facilitates selection of a particular club by at least partially separating the clubs and reducing clustering and overlap.

Advantageously, the convenience in club selection afforded by the present invention is accompanied by convenience in club storage and retrieval. Once a club is selected, the club is easily retrieved, since there are no restrictive channels, retaining mechanisms, or other impediments to quick and easy removal of the club. In addition, the lack of restrictive channels or retaining mechanisms allows the golf clubs to be easily stowed; the clubs can simply be placed in the golf bag without any tedious positioning or guiding. The features of the golf bag of the present invention thus provide enhanced organization and ease of use.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A golf bag for holding a plurality of golf clubs, the golf bag comprising:

a club storage portion having a base, an open upper end, and an enclosed sidewall extending between the base and the open upper end and having a front and a back;

a stand disposed longitudinally on the sidewall front, the stand having a closed position and an open position such that the stand in the open position supports the golf bag in a partially reclined position; and at least one ridged element disposed within the open upper end, said at least one ridged element having a plurality of valleys separated by ridges, the valleys having a size and shape adapted to loosely accommodate a golf club shaft, and said at least one ridged element being oriented such that when the golf bag is in the partially-reclined position, at least some of the golf clubs contained therein rest unrestrained within the valleys of the ridged element to facilitate retrieval thereof.

2. The golf bag of claim 1, which further comprises at least one divider extending across the open upper end transverse to a sidewall front to sidewall back axis, the divider having a front surface proximate to the sidewall front and a back surface proximate to the sidewall back.

3. The golf bag of claim 2, wherein the ridged element is disposed on at least one divider along a portion of the divider back surface.

4. The golf bag of claim 2, wherein the ridged element is disposed along a portion of an inner surface of the open upper end proximate to the sidewall front.

5. The golf bag of claim 4, having at least one additional ridged element disposed on the at least one divider along a portion of the divider back surface.

6. The golf bag of claim 2, having at least two dividers, wherein the dividers are separated from and substantially parallel to each other, each divider having a ridged element disposed on the back surface.

7. The golf bag of claim 6, having a ridged element disposed along a portion of an inner surface of the open upper end proximate to the sidewall front.

8. The golf bag of claim 1, wherein the ridged element is disposed along a portion of an inner surface of the open upper end proximate to the sidewall front.

9. The golf bag of claim 1, wherein the shape of the valleys is approximately a U-shape.

10. The golf bag of claim 1, wherein the shape of the valleys is approximately a V-shape.

11. The golf bag of claim 1, wherein the ridges have a shape that is approximately a U-shape, the U-shape being inverted relative to the shape of the valleys.

12. The golf bag of claim 1, wherein the ridges have a shape that is approximately a V-shape, the V-shape being inverted relative to the shape of the valleys.

13. A golf bag for holding a plurality of golf clubs, the golf bag comprising:

a club storage portion having a base, an open upper end, and a circumferential sidewall extending between the base and the open upper end and having a front and a back;

a stand disposed longitudinally on the sidewall front, the stand having a closed position and an open position such that the stand in the open position supports the golf bag in a partially reclined position;

at least one divider extending across the open upper end transverse to a sidewall front to sidewall back axis, the divider having a front surface proximate to the sidewall front and a back surface proximate to the sidewall back; and a first ridged element disposed along a portion of an inner surface of the open upper end proximate to the sidewall front, and a second ridged element disposed on the divider back surface, said ridged elements having a plurality of valleys separated by ridges, the valleys having a size and shape adapted to loosely accommodate a golf club shaft, and said ridged elements being oriented such that when the golf bag is in the partially-reclined position, at least some of the golf clubs contained therein rest unrestrained within the valleys of the ridged elements to facilitate retrieval thereof.

* * * * *